United States Patent [19]

Buente et al.

[11] Patent Number: 4,688,526

[45] Date of Patent: Aug. 25, 1987

[54] SELF-CONTAINED HYDRAULIC BUCKET LIFTER

[75] Inventors: Stephen M. Buente; George A. Hillebrand, both of Battle Creek, Mich.

[73] Assignee: Eaton Corporation, Cleveland, Ohio

[21] Appl. No.: 798,261

[22] Filed: Nov. 14, 1985

Related U.S. Application Data

[63] Continuation-in-part of Ser. No. 559,127, Dec. 7, 1983, abandoned.

[51] Int. Cl.[4] ..... F01L 1/24

[52] U.S. Cl. ..... 123/90.58; 123/90.55

[58] Field of Search ..... 123/90.43, 90.46, 90.55, 123/90.58

[56] References Cited

U.S. PATENT DOCUMENTS

| | | | |
|---|---|---|---|
| 2,833,257 | 5/1958 | Lengnick | 123/90.58 X |
| 3,495,577 | 2/1970 | Collins | 123/90.58 X |
| 3,521,608 | 7/1970 | Scheibe | 123/90.58 |

FOREIGN PATENT DOCUMENTS

| | | | |
|---|---|---|---|
| 43275 | 3/1980 | Japan | 123/90.58 |
| 2093940 | 9/1982 | United Kingdom | 123/90.55 |

*Primary Examiner*—William R. Cline
*Assistant Examiner*—Peggy Neils
*Attorney, Agent, or Firm*—D. A. Rowe; F. M. Sajovec

[57] ABSTRACT

A hydraulic lash adjusting tappet (10) for use in engine valve gear of the direct-acting type having one end of the tappet contacting the end (26) of the combustion chamber valve stem (22) and the other end contacting the camshaft lobe (16). The tappet has a body (34) formed with a tubular wall portion (36) having one end thereof closed by an end wall (38) and with a tubular hub (40) therewithin formed integrally with the end wall and extending axially therefrom. A lash adjuster assembly (44) is slidingly received in the tubular hub which defines a reaction surface (50) remote from the cam face reaction surface (18) defined by the end wall. A seal (88) defines an expansible closed fluid reservoir (114) in combination with the body and includes a compliant diaphragm (90) carried about the outer circumferential portion (92) thereof by said body and a sleeve cap (52) insert-molded within the inner circumferential portion (110) of the diaphragm to provide a central portion (104) wear surface interposed, in application, between the lash adjuster reaction surface and the valve stem. In the preferred embodiment the compliant diaphragm has a plurality of circumferentially spaced accumulators (226, 232) for absorbing by flexure thereof, pressure transients in the reservoir and has stiffening ribs (234, 240) integrally formed between the accumulators.

18 Claims, 8 Drawing Figures

SELF-CONTAINED HYDRAULIC BUCKET LIFTER

CROSS REFERENCES TO RELATED APPLICATIONS

This application is a continuation-in-part of our copending application Ser. No. 559,127 filed Dec. 7, 1983 now abandoned.

FIELD OF THE INVENTION

The present invention relates generally to hydraulic lash adjusters or lifters as they are sometimes referred to and the like for maintaining substantially zero lash in motion-transmitting mechanisms such as, for example, cam-operated valves of internal combustion engines, and particularly to hydraulic valve lifters of the bucket-type which directly interconnect the cam and valve stem of an overhead cam and valve engine. More specificially, the present invention relates to hydraulic valve lifters of the self-contained type within direct-acting valve gear.

BACKGROUND OF THE INVENTION

In designing valve gear for internal combustion engines operating at speeds in excess of 5,000 RPM, it has been found desirable to employ valve gear of the cam-over-valve type. Valve gear of this type is known as direct-acting valve gear and employs a tappet having one end contacting the engine camshaft with the other end of the tappet in direct contact with the end of the stem of the combustion chamber valve. Direct-acting valve gear offers the advantages of low mass, fewer working parts and higher stiffness due to the elimination of the rocker arm and/or push rods. Low mass and high stiffness result in a high natural resonant frequency which allows the valve gear to attain higher RPM's before valve mis-motion occurs. Direct-acting valve gear also permits the use of lighter valve spring loads for a given valve motion and engine speed as compared with those used in other valve gear arrangements. The low mass and high stiffness of the system also permits valve lift velocities and accelerations which increase the area under the valvelift curve and thus provide increased specific engine output. Although other overhead cam configurations can be made to have comparable lift velocities and accelerations, a direct-acting valve gear arrangement offers the additional advantage of permitting rotation of the cam-contacting surfaces as the lifter rotates, which is not permissible with rocker arm type valve gear arrangements. Direct-acting valve gear arrangements, therefore, allow higher permissible cam contact stresses.

In addition, the cam profile for other overhead cam valve gear arrangements with high lift accelerations and velocities is more complex than that required for direct-acting valve gear. The simpler cam profile requirement of direct-acting valve gear results in less manufacturing difficulties and less cost in the valve gear when high velocities and accelerations are desired.

Conventional lash adjusters compensate for fluid leakage by means of supplying pressurized fluid to the interior of the lash adjuster through passageways in the cylinder head or block. However, there are disadvantages to such an arrangement since the passageways through which the pressurized fluid flows are complicated in construction, and the operation is often unstable due to changes in the viscosity of the pressurized fluid. In order to eliminate such disadvantages, hydraulic lash adjusters of the self-contained type have been provided which are not fed from an external source of hydraulic fluid but which contain their own source of such fluid.

Self-contained lash adjusters overcome many of the shortcomings of conventional lash adjuster arrangements. Because no external source of hydraulic fluid is required, self-contained lash adjusters are easily applied to engines since no oil galleries are required. Furthermore, because no fluid is supplied to the outside diameter of the adjuster, leakage therefrom will not collect within the engine block and head as has been heretofore experienced. Because self-contained lash adjusters do not communicate with their host engine's hydraulic (lubrication) system, they do not become subject to the contaminants and air bubbles contained therein. The presence of air-free hydraulic fluid within a lash adjuster is desirable, particularly in reducing cold-start cavitation which, in the worst case, can cause collapse of the lash adjuster. Additionally, by containing its own reservoir of hydraulic fluid, a self-contained lash adjuster provides improved control over leakdown by permitting use of hydraulic fluid having a viscosity differing from that of the host engine fluid. A still further advantage of self-contained lash adjusters is their independence from engine fluid pressure which tends to be high during cold-start conditions and low at hot idle.

Although having many advantages over conventional lash adjuster arrangements, prior art self-contained lash adjusters have a number of shortcomings. Because self-contained lash adjusters, by definition, have no outside source of hydraulic fluid, the fluid contained therein at the time of manufacture must remain intact for the life of the lash adjuster. Accordingly, a virtually perfect seal is required to prevent any self-contained lash adjuster hydraulic fluid from escaping. Providing such a seal has been a difficult problem and an area of weakness in virtually all prior art commercial self-contained lash adjusters. The prior art patent literature has recognized this problem and has acknowledged that some leakage is inevitable by providing arrangements for compensating for limited amounts of hydraulic fluid loss. More specifically, the sealing problems in self-contained lash adjusters have been described as having two distinct aspects. First, all such lash adjusters require an absorption chamber to account for differential volumes of reservoir fluid. The shortcoming of prior art absorption chambers has been the difficulty encountered in establishing and maintaining a seal between two reciprocating elements. Such motion tends to substantially reduce the life of the seal through fatigue embrittlement and the like. The second aspect is the sealing function of the high-pressure portion of the lash adjuster. Prior art approaches have employed a dynamic or sliding seal which, by its nature, is susceptible to mechanical wear from sliding contact against less-than-perfect surface finishes. A still further problem inherent to self-contained lash adjusters is the requirement for some form of anti-rotation device between the lash adjuster piston and the body, which allows relative axial reciprocating motion but prevents relative rotation therebetween, to prevent torsional stressing of the interconnecting membrane seal. Furthermore, assembly of prior art self-contained lash adjusters has been complicated by the necessity to purge all air from the assembled unit. A typical manufacturing process can require assembly of the lash adjuster while submerged in hydraulic fluid.

It has been found difficult to provide direct-acting valve gear in engine applications where the height of the engine must be kept to a minimum, particularly where it is desired to locate the camshaft closely adjacent the end of the combustion chamber valve stem. Furthermore, where it is desired to retrofit a hydraulic lash-adjusting tappet into the direct-acting valve gear of a production engine, it is often difficult to provide a hydraulic lash-adjusting tappet in the existing space provided between the camshaft and the end of the valve stem. Where the tappet must be guided in a bore defined by engine structure intermediate the camshaft and the end of the valve stem, incorporation of hydraulic tappets tends to increase the engine height.

Therefore, it has been desired to find a self-contained hydraulic lash-adjusting tappet with a compact profile height for use in engines having direct-acting valve gear with minimum distance between the camshaft and the end of the valve stem to minimize the mass of engine structure necessary to provide the tappet guides. Furthermore, in designing tappets for direct-acting valve gear so as to minimize sideloading in the guide for minimizing wear, it is desirable to have the reaction force of the valve stem centered through the tappet at a point as closely adjacent the cam surface as possible. Locating the reaction force near the cam face also permits the tappet to be designed to minimize the mass which, in turn, reduces inertia.

Known hydraulic tappets for self-contained direct-acting valve gear have employed a body or bucket, formed as an integral unit having a reservoir defined by the closed end of the body and an annular diaphragm. One such tappet is that shown and described in U.S. Pat. No. 3,521,608 to Scheibe, wherein the diaphragm is sealed about the outer circumference thereof to the body and engages the plunger portion of the lash adjuster at the inner circumference thereof. Although providing a relatively small tappet profile, seal arrangements such as that shown in the Scheibe patent can have shortcomings when the device is applied to certain application, particularly those requiring long life and minimal hydraulic fluid leakage. Although the Scheibe device may overcome some of the above-described shortcomings of other prior art devices by eliminating need for a dynamic seal, the problem of a fluid-tight absorption chamber requiring life-long seal integrity has remained. In the applicants' experience, problems in prior art designs of this type have arisen in the area of interface between the valve stem and plunger assembly. Because the lash adjusting mechanism reciprocates axially at his point, the seal tends to deteriorate rapidly by pulling away from the reaction member for transmitting forces to the valve and becomes brittle and ruptures in an area point of maximum excursion.

SUMMARY OF THE INVENTION

The present invention provides a self-contained hydraulic lash adjusting tappet of the type used in direct-acting valve gear for internal combustion engines operating at high RPM. The hydraulic tappet of the present invention is of the type having a general configuration known as a "bucket" wherein the body of the tappet has a diameter substantially larger than that of the hydraulic plunger contained therein for being received over the end of a valve spring. The present invention overcomes many of the shortcomings of the prior art by providing a design which eliminates the need for a dynamic seal, reduces the damaging effects of high transient pressures on the diaphragm to enhance seal life, and provides an extremely small profile and provides ease of assembly. The self-contained hydraulic lash adjusting tappet of the present invention includes a body with structure defining an outer annular wall closed at one end thereof by a transversely extending end wall with an annular hub therein. Hydraulic lash adjusting means are received within the hub and define a reaction surface which, in application, contacts one or more associated components of the valve gear of the host engine for effecting lash adjustment thereof. Finally, seal means are provided which, in combination with the body means, define an expansible closed fluid reservoir. The seal means includes a compliant diaphragm having an outer circumferential portion thereof retained within the body means to establish a fluid-tight seal therebetween. The seal means includes a floating central portion defining a wear face which, in application, is interposed between and radially restrained by a reaction surface, defined by the lash adjuster means, and one of said associated components of the engine valve gear such as the end of the valve stem. This arrangement provides a relatively low-cost design with a seal configured to minimize the stresses imposed thereon by the operation of the tappet to thereby maximize the sealing integrity and the life expectancy thereof.

In the preferred embodiment of the invention, accumulator means are provided, which communicate with the fluid reservoir and operate to absorb reservoir fluid pressure transients, associated with operation of the lash adjuster, by localized bending deformation. This arrangement provides the advantage of reducing the shock-stressing of pressure transients imposed on the seal diaphragm to enhance the life thereof.

According to another aspect of the present invention, the above-described accumulator means is defined by one or more displacement pockets integrally formed, such as by molding, with the seal diaphragm and extending within the fluid reservoir at a point radially intermediate the outer wall of the body structure and the hub. The pockets have the outer surfaces thereof normally communicating with fluid in the reservoir and the inner surfaces normally communicating with ambient pressure, typically the atmosphere. In the preferred embodiment, a plurality of such displacement pockets are formed in the diaphragm and are circumferentially arranged within the fluid reservoir and interspaced by generally radially extending web portions, which add rigidity to the overall diaphragm assembly. In the preferred practice, the outer peripheral rim is axially offset from the inner peripheral portion; and, axially extending stiffening ribs are provided in the spaces between the accumulator pockets. This arrangement provides the advantage of an extremely strong seal diaphragm, which has one or more accumulators provided therein whereby hydraulic fluid pressure transients from operation of the tappet are absorbed by the accumulators through flexing and displacement thereof rather than compression or tension loading of the diaphragm itself.

According to another aspect of the invention, a sleeve cap is insert-molded with an inner circumferential portion of the diaphragm to define the above-mentioned wear surface. The sleeve cap defines a central portion which is interposed, between the reaction surface of the lash adjuster and the end of the engine valve stem. This arrangement has the advantage of keeping the seal assembly discreet from the lash adjuster assembly to aid in the manufacture of the tappet. Furthermore, the likelihood of separation between the sleeve cap and the diaphragm is minimized by the insert molding of the cap therein with retention surfaces on the cap which are positively engaged by the molded material for providing improved retention thereon.

According to another aspect of the present invention, an access bore is provided between a check valve within the high-pressure portion of the lash adjuster assembly and the lash adjuster reaction surface. This arrangement has the advantage of enabling a probe to be inserted through the bore for overriding of the check valve for purging air from the high-pressure portion of the lash adjuster assembly during manufacture.

According to still another aspect of the present invention, a lash adjuster assembly retainer is provided which operates to limit axial displacement of the lash adjuster assembly to a limit less extensive than the position of the lash adjuster assembly when air was initially purged therefrom to prevent establishing a negative pressure within the lash adjuster. Simultaneously, the retainer also prevents relative rotation displacement between the lash adjuster assembly and the body to prevent torsional stressing of the diaphragm.

These and other aspects and advantages of the present invention will become apparent upon reading the following Specification which, along with the application drawings, describes and discloses a preferred embodiment of the invention as well as modifications thereof, in detail.

DETAILED DESCRIPTION OF THE PREFERRED EMBODIMENTS OF THE INVENTION

Figure 1:
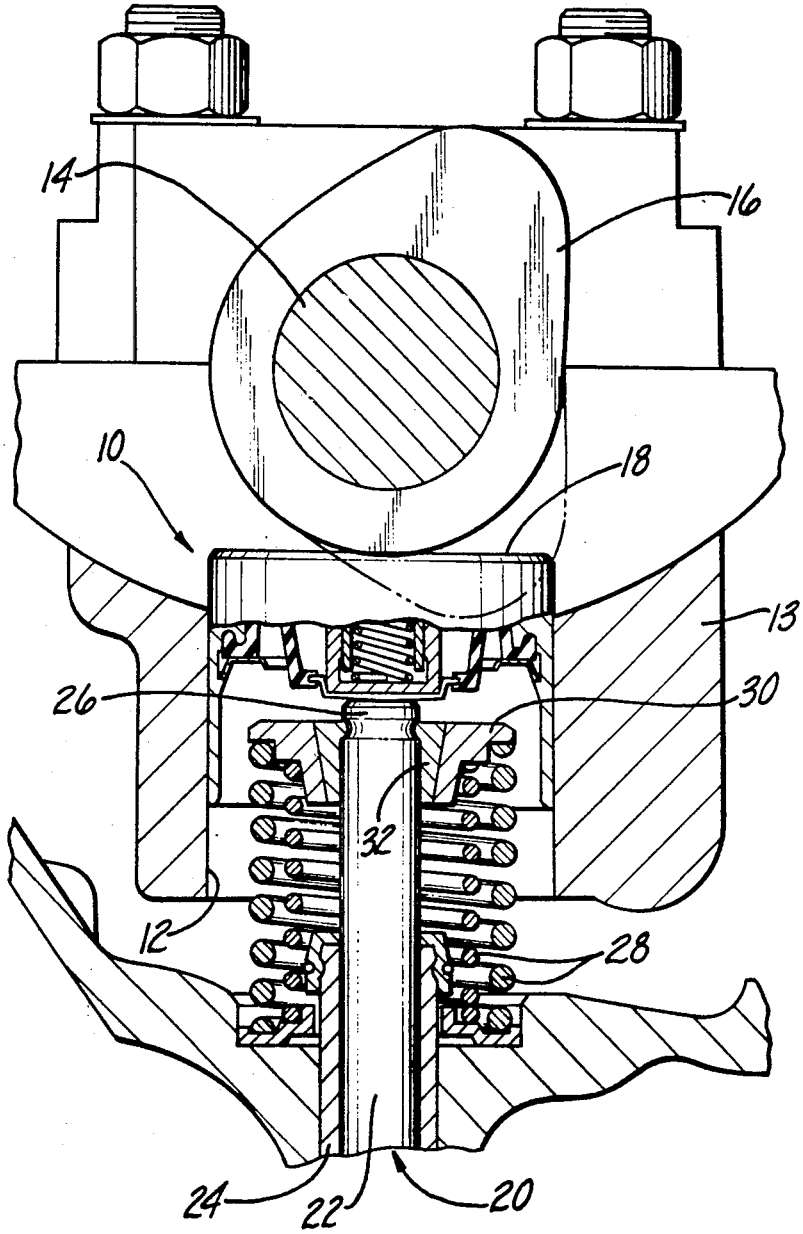
FIG. 1 is a cross-section of a portion of the direct-acting valve gear of an internal combustion engine illustrating the tappet as installed in the engine.

Referring to FIG. 1, a bucket tappet indicated generally at 10 is slidably received in a guide bore 12 provided in the cylinder head 13 of the engine structure. A camshaft 14 having a cam lobe 16 contacts the upper end or cam face reaction surface 18 of the tappet. A typical combustion chamber valve 20 is shown seated on a valve seating surface formed in the cylinder head 13 with the stem portion 22 of the valve extending substantially vertically upward through valve guide 24 formed in the cylinder head 13, with the upper end 26 of the valve stem contacting the lower end of the tappet. The valve is biased to the closed position by concentric valve springs 28, having their lower ends registered against the exterior of the upper portion of the valve guide 24 and their upper ends in contact with a retainer 30 secured to the valve stem adjacent its upper end and retained thereon in a suitable manner, as for example, by the use of a split keeper 32 which is well known in the art.

Figure 4:
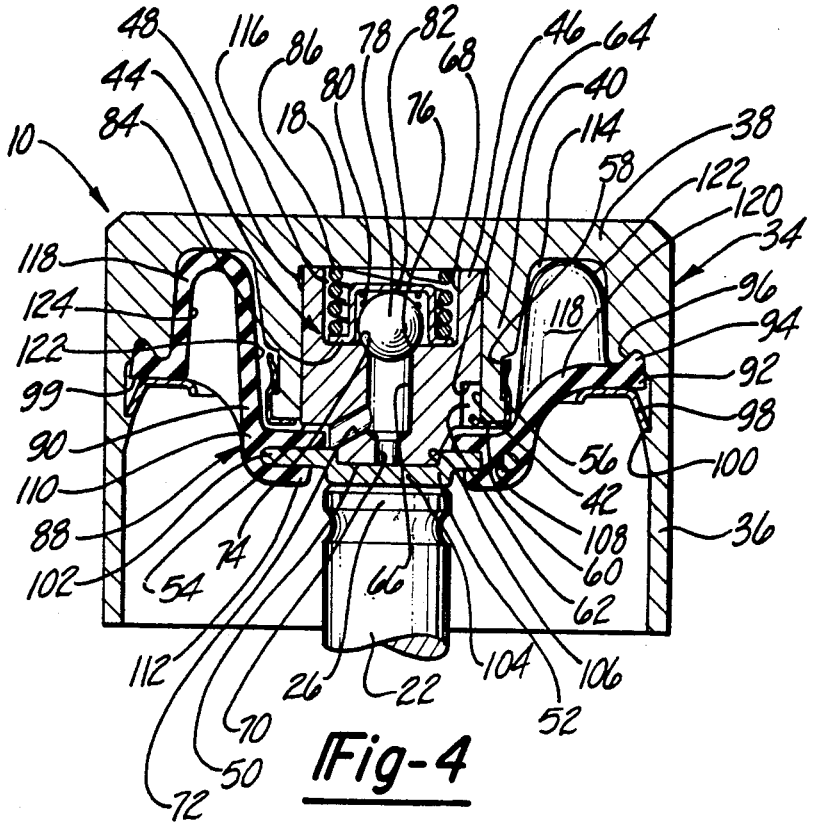
FIG. 4 is a cross-sectional view of a second alternative and the currently preferred embodiment of the tappet illustrated in FIG. 2.
Figure 5:
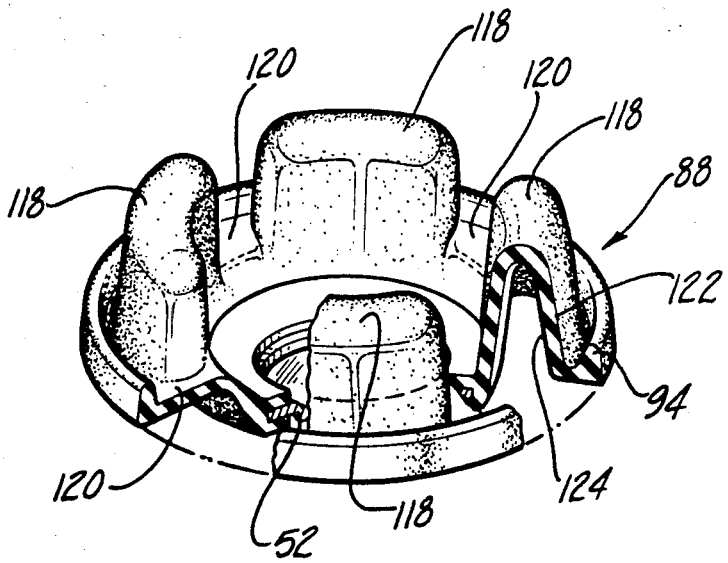
FIG. 5 is a perspective broken view of the seal assembly of the tappet of FIG. 4.

Referring now to FIGS. 4 and 5, the presently preferred embodiment of the tappet 10 is shown wherein the body, indicated generally at 34, is formed preferably integrally with an outer tubular wall portion 36 closed at one end by a transversely extending end wall 38. The upper or outside surface of end wall 38 defines cam face reaction surface 18. A tubular hub portion 40 is integrally formed with end wall 38 within outer wall 36 and extends downwardly therefrom. Hub 40 defines a lash adjuster assembly receiving bore 42 opening downwardly and in general axial alignment with outer wall 36. A lash adjuster assembly, indicated generally at 44, is slidably received within bore 42. The outer periphery of outer wall 36 is sized to be received in the tappet guide bore 12 (see FIG. 1) in a generally closely fitting relationship. Although the outer wall, web and hub have been described as preferably formed integrally, it will be understood that such portions may be formed separately and the body formed by joining those portions, as for example, be weldment, such as fusion or brazing.

In the presently preferred practice, the tappet body is formed of a suitable steel alloy as, for example, an alloy containing a desired amount of chromium and is suitably hardened for wear resistance. However, it is contemplated that the body could be formed from iron-based material as, for example, steel or cast iron and a separate disc-shaped face member welded thereto to define cam face reaction surface 18.

It will also be understood that other materials, for example, nickel or aluminum alloys may be used or hardenable cast iron or ceramic materials, or cermets may be employed if desired.

Lash adjuster assembly 44 includes a plunger 46 having the outer periphery 48 thereof in sliding closely fitting relationship with bore 42. Outer periphery 48 and bore 42 comprise leakdown surfaces, the function of which will be described in detail hereinbelow. The plunger 46 has a transverse face 50 thereof, or lower face with respect to FIG. 4, adapted for driving engagement with the end 26 (see FIG. 1) of the combustion chamber valve stem through an intermediate sleeve cap 52, the function of which will be described hereinbelow.

In the presently preferred practice, the plunger 46 is formed of steel with face 50 suitably hardened for wear resistance. The outer periphery 48 of the plunger 46 has an annular shoulder 54 formed thereon at the intersection with the lower face 50. An annular retainer 56 is received on the open end of hub 40 and engaged therewith, preferably in a groove 58 formed in the outer periphery of hub 40. Retainer 56 has one or more tangs 60 extending radially inward of bore 42, each registering within a local nitch 62. The uppermost extent of nitch 62 defines a local step 64. Tang 60 operates to limit axial displacement of plunger 46 at the point where tang 60 contacts step 64. Simultaneously, tang 60 operates to prevent substantial relative rotational repositioning of plunger 46 and body 34. Plunger 46 is illustrated in its collapsed or upwardmost limit of travel.

Plunger 46 has a fluid passage 66 formed vertically and preferably centrally with a counterbore 68 formed therein. The bottom end of passage 66 includes a concentric probe bore 70 and a radially extending vent passage or oil feed hole 72 interconnecting fluid passage 66 with outer periphery 48 of plunger 46 at a point adjacent shoulder 54. Counterbore 68 has a flat bottom 74 which intersects passage 66 in an annular seating surface 76. A one-way valve member in the form of a check ball 78 rests against the annular seating surface 76 and is biased thereagainst by a suitable expedient as, for example, a conical check ball spring 80. The check ball 78 is retained by a cage 82 which has an outwardly extending flange 84 received in counterbore 68 and retained therein by suitable means as, for example, a press fit. The cage 82 is provided with one or more apertures of passageways (not shown) to enable the flow of fluid therepast. The subassembly of the check ball, cage and plunger 46 is biased downwardly by a plunger spring 86 having its upper end registered against the closed end of bore 42 and its lower end registered against flange 84 of check ball cage 82.

A seal assembly, indicated generally at 88, is received within body 34 and includes a generally annular compliant diaphragm 90 formed preferably of rubber or other suitable material and sleeve cap 52. The outer circumferential portion 92 of diaphragm 90 has a bead 94 formed therein, which is nestingly received within a complimentarily shaped annular mating surface 96 in outer wall 36 and retained therein by an annular spring clip 98, which is held in position by an annular radially inwardly directed shoulder 100 formed on the inner surface of outer wall portion 36. Spring clip 98 is dimensioned so as to bear against lower surface 99 of outer circumferential portion 92 and radial restraint effected upon the "wear surface" of the seal, such as pure coefficient of friction of the sandwiching plunger 46 and upper portion 26, obviating the need for "nesting". Such radial restraint takes place in application only. Otherwise, the wear surface floats or self-locates adjacent the lash adjuster reaction surface.

Seal assembly 88 and body 34 coact to define an expansible closed-fluid reservoir 114. Fluid in reservoir 114 is communicated to check ball 78 through vent passage or oil feed hole 72 and fluid passage 66. The region above check ball 78 and seating surface 76 and bounded by counterbore 68 and bore 42 of hub 40 comprises a high-pressure fluid chamber 116 for retaining therein fluid entering through passage 66 upon opening of the check ball 78.

Diaphragm 90 has integrally formed therein four upwardly directed displacement accumulators or pockets 118 which are circumferentially spaced by intermediate radially extending web portions 120 of diaphragm 90. Each displacement pocket 118 has outer surfaces 122 communicating with fluid within reservoir 114 and inner surfaces 124 communicating with ambient pressure, which in intended application, will be the atmosphere. Although four displacement pockets 118 are illustrated, it is contemplated that one or more could be employed. However, if two or more are used, they should be interspaced by web portions 120. Displacement pockets 118 are intended to function as resilient accumulators which momentarily absorb reservoir fluid pressure transients associated with lash adjustment when plunger 46 is repositioned and fluid exits from between leakdown surfaces 42 and 48. Although all transient phenomena and forces upon diaphragm 90 have not been analyzed in detail, the applicants surmise that the improved operation observed after including the displacement pockets is a result of reduced tension and compression forces imposed on diaphragm 90. Momentarily flexing and collapsing displacement of displacement pockets 118, lowering total positive pressure on diaphragm 90 and therefore enhancing the life thereof.

In operation, check ball 78 is biased in a closed position by spring 80 and upon rotation of the camshaft in time relationship with the events of the combustion chamber to the position shown in solid outline in FIG. 1, the upper surface 18 of tappet 10 is registered against the base circle portion of the cam with the lobe 16 oriented so as not to contact the cam face 18 of the tappet. Upon rotation of the camshaft 14 to the position shown in dashed outline in FIG. 1, the cam lobe contacts the cam face reaction surface 18 of the tappet 10, causing the tappet to move downwardly, thereby opening the combustion chamber valve 20. Upon subsequent rotation of the camshaft to return to the solid outline position of FIG. 1, the valve event is complete and the valve is reseated on the valve seat.

In operation, with the engine cam lobe 16 in the position shown in FIG. 1, the plunger spring 86, aided by hydraulic pressure in fluid chamber 116, maintains the lower face 50 of plunger 46 in contact with the upper surface of recessed central portion 104 of sleeve cap 52 which, in turn, is maintained in contact with upper end 26 of valve stem 22 thereby eliminating lash in the valve gear. This causes expansion of chamber 116, which draws open the check ball 78 permitting fluid to flow into chamber 116 from passage 66. Upon succession of the expansion of chamber 116, the check ball 78 closes under the biasing of spring 80. Upon subsequent rotation of cam lobe 16, the ramp of the cam lobe begins to exert a downward force on the upper face 18 of the tappet, tending to compress the plunger 46 into bore 42, which compression is resisted by fluid trapped in chamber 116. The fluid trapped in chamber 116 is to prevent substantial movement of the plunger 46 relative to body 34, and it transmits the motion through the bottom face 50 of plunger 46 into the top of valve stem 26 through sleeve cap 52. It will be understood by those having ordinary skill in the art that a minor movement of the plunger 46 with respect to body 34 occurs, the magnitude of which is controlled by the amount of fluid permitted to pass through the aforesaid leakdown surfaces 42 and 48. The plunger and body thus act as a rigid member transmitting further lifts of cam lobe 16 for opening the valve to the position shown by dashed line in FIG. 1.

Probe bore 70 is provided to facilitate assembly of tappet 10 by providing a passageway between face 50 of plunger 46 and check ball 78.

In-process verification of the subassembly comprising body 34 and lash adjuster assembly 44 can be effected prior to installation of seal assembly 88 by inserting a probe through bore 70 in passage 66 to momentarily displace check ball 78 from seating surface 76. Once seal assembly 88 is installed, probe 70 serves no further purpose.

Figure 3:
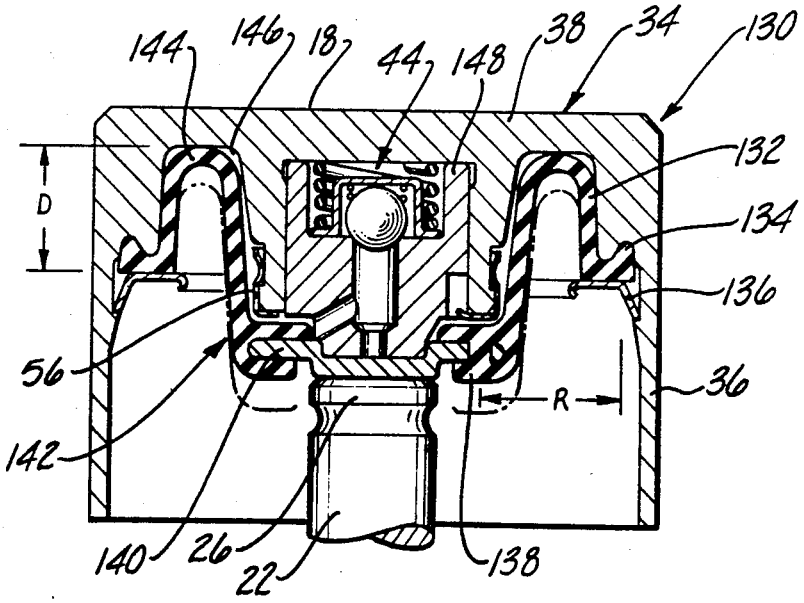
FIG. 3 is a cross-sectional view of an alternative embodiment of the tappet illustrated in FIG. 2.

Referring to FIG. 3, an alternative embodiment of the bucket tappet is shown generally at 130 as employing a circumferentially symmetrical rolling type diaphragm 132 having an outer peripheral bead 134 retained in position by a spring clip 136 and an inner peripheral area of increased thickness 138 with an annular rim portion of a sleeve cap 140 insert-molded therein to comprise a seal assembly indicated generally at 142.

Rolling diaphragm 132 has a convolution 144 extending within a fluid reservoir 146. Definitionally, "convolutions" are to be interpreted for the purposes of this application and any patent issuing therefrom as meaning on or more roll or undulation of diaphragm 132. Operation of bucket tappet 130 is substantially as disclosed and described in connection with the discussion of the embodiment illustrated in FIGS. 4 and 5 hereinabove. As shown by phantom line, convolution 144 will roll with inner peripheral area 138 as plunger 148 is displaced outwardly. Although the dimensions of diaphragm 132 will vary as a function of actual application, it is contemplated that the following general relationships will remain true. Convolution 144 will extend axially a nominal dimension indicated at D which is dimensionally substantially coextensive with the nominal radial spacing (designed R) of the bead 134 and area of increased thickness 138.

Figure 2:
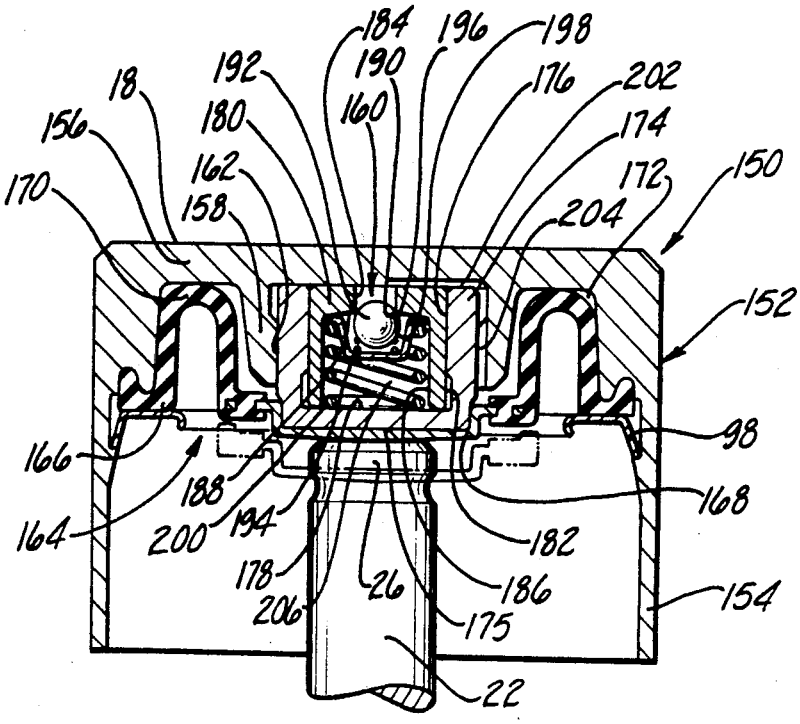
FIG. 2 is a cross-sectional view of the tappet illustrated in FIG. 1 showing the internal details thereof.

Referring to FIG. 2, a second alternative embodiment of a bucket tappet 150, is illustrated, including a body with structure defining an outer tubular wall portion 154, a transversely extending end wall 156 and an annular hub 158. A lash adjuster assembly 160 is slidingly received within a bore 162 defined by hub 158. Finally, a seal assembly 164 completes the assembly and includes a compliant rolling diaphragm 166 and a central insert-molded sleeve cap 168. With the exceptions discussed hereinbelow, bucket tappet 150 operates substantially identically as the preferred embodiment discussed hereinabove with respect to FIGS. 4 and 5.

Diaphragm 166, like diaphragm 132 (refer to FIG. 3) is circumferentially symmetrical and includes a convolution 170 extending within a fluid reservoir 172. The inner periphery of bore 162 of hub 158 has received therein a plunger 174 in sliding closely fitting relationship therewith. Plunger 174 has a transverse face thereof, or lower face with respect to FIG. 2, adapted for nesting engagement with sleeve cap 168 for driving valve stem 22. No retainer is illustrated in the embodiment of FIG. 2 although it is contemplated that one would be employed in practice for the reasons set forth hereinabove.

Plunger 174 has a precision cylindrical bore 176 formed in the upper end thereof with the lower end thereof terminating in a shouldered flat bottom 178. The precision bore 176 has slidably received therein in very closely fitting relationship a piston member 180, the outer periphery 182 thereof being of precision diameter and smoothness so as to provide control of the leakdown or passage of pressurized fluid therebetween. In the presently preferred practice, both the plunger 174 and the piston 180 are formed of a suitable steel material.

Piston 180 has a fluid passage 184 formed vertically and preferably centrally therethrough. The bottom end of the passageway 180 has a counterbore 186 provided in the lower end of piston 180 which counterbore has a generally flat top 188 which intersects the passageway 184 in an annular seating surface 190. A one-way valve member in the form of a check ball 192 rests against the annular seating surface 190, and is biased thereagainst by a suitable expedient as, for example, a check ball spring 194. The check ball 192 is retained by a cage 196 which has an outwardly extending flange 198 received in counterbore 186 and retained therein by a suitable means as, for example, a press fit. The cage 196 has an aperture (not illustrated) to allow fluid communication thereby. The subassembly of the check ball 192, cage 196 and piston 180 is biased upwardly by a plunger spring 200 having its upper end registering against flange 198 of the check ball cage 196 and its lower end contacting the bottom 178 of the plunger 174.

Fluid passage 184 communicates with reservoir 172 through a series connected radially extending bypass recess 202 formed in the lower surface of end wall 156 and an axially extending bypass recess 204 formed in bore 162 of hub 158. Bypass recesses 202 and 204 function to maintain passageway 184 and reservoir 172 in continuous fluid communication. It will be understood that piston 180 is maintained in the upward extreme position and against the undersurface of end wall 156, as illustrated in FIG. 2 by spring 200 and the hydraulic pressure in chamber 206.

The region 206 below check ball 172 and seat 190 and bounded by bore 186 of piston 180, bore 176 of plunger 174 and bottom 178 of plunger 174 comprise a high-pressure fluid chamber for retaining therein fluid entering passage 184 upon opening of the check ball 192.

In operation, check ball 192 is biased in a closed position by spring 194 and upon rotation of the camshaft in timed relation to the events of the combustion chamber to the position shown in solid outline in FIG. 1, the upper surface of the tappet is registered against the base circle of the cam with the lobe 16 oriented so as not to contact the cam face 18 of the tappet. Upon rotation of the camshaft 14 to the position shown in dashed outline in FIG. 1, the cam lobe contacts the upper face 18 of the tappet, causing the tappet to move downwardly, thereby opening the combustion chamber valve. Upon subsequent rotation of the camshaft to return to the solid outlined position of FIG. 1, the valve event is complete and the valve is reseated on the valve seat. In operation, with the engine cam lobe 16 in the position shown in FIG. 1, the plunger spring 200, aided by hydraulic pressure, maintains the upper end of piston 180 in contact with the under surface of end wall 156 and urges the plunger 174 in the downward direction until the end face 175 thereof contacts the upper face 26 of the valve stem 22 (through sleeve cap 168) thereby eliminating lash in the valve gear. This causes expansion of the chamber 206 which draws open the check ball 192 permitting fluid to flow into chamber 206. Upon succession of expansion of chamber 206, the check ball 192 closes under the biasing of spring 194. Upon subsequent rotation of the cam lobe 16, the ramp of the cam lobe begins to exert a downward force on the upper face 18 of the tappet tending to compress the piston 180 into the bore 176 of the plunger which compression is resisted by the fluid trapped in chamber 206. The fluid trapped in chamber 206 prevents substantial movement of the piston 180 relative to plunger 174 and transmits the motion through the bottom face of plunger 174 onto the top of the valve stem 26. It will be understood by those having ordinary skill in the art that a minor movement of the plunger with respect to the piston occurs, the magnitude of which is controlled by the amount of fluid permitted to pass through the aforesaid leakdown surfaces 176 and 182. The piston 180 and plunger 174 thus act as a rigid member transmitting further lifts of cam lobe 16 of opening the valve.

The novel construction of the tappet 150 illustrated in FIG. 2 provides the lash adjustment by a precision fit of a piston in a bore formed in a plunger slidably received in the hub, and thus eliminates the need for precision fitting leakdown control surfaces on the interior of the tappet hub. The external retention means illustrated in the embodiments of FIGS. 3 and 4 permit ease of manufacture and ready removal of the hydraulic plunger assembly for cleaning and/or parts replacement. Furthermore, spring clips 98 and 136 provide effective substantially fluid-tight seals between the outer circumference of the diaphragm and the body while permitting disassembly and service, if required, without destruction or degradation of the tappet.

Figure 6:
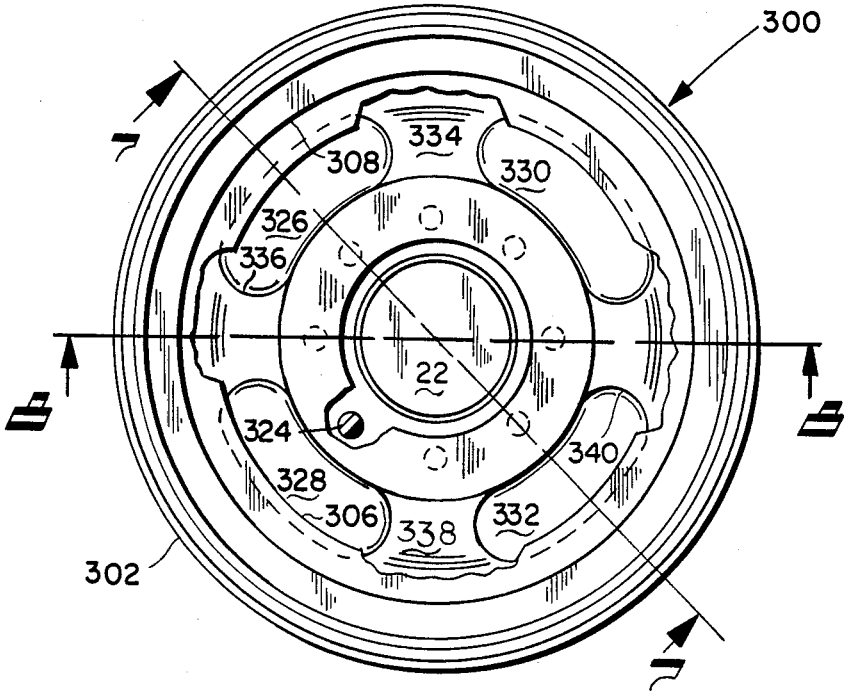
FIG. 6 is a plan view of a tappet inverted with respect to FIG. 1 for another embodiment of the invention.

Referring now to FIG. 6, an alternate embodiment of the invention is illustrated indicated generally by reference numeral 300 and has a generally cup-shaped body 302 having a diaphragm subassembly received in the open end thereof for defining a flexible closing wall for a fluid reservoir 303.

Figure 7:
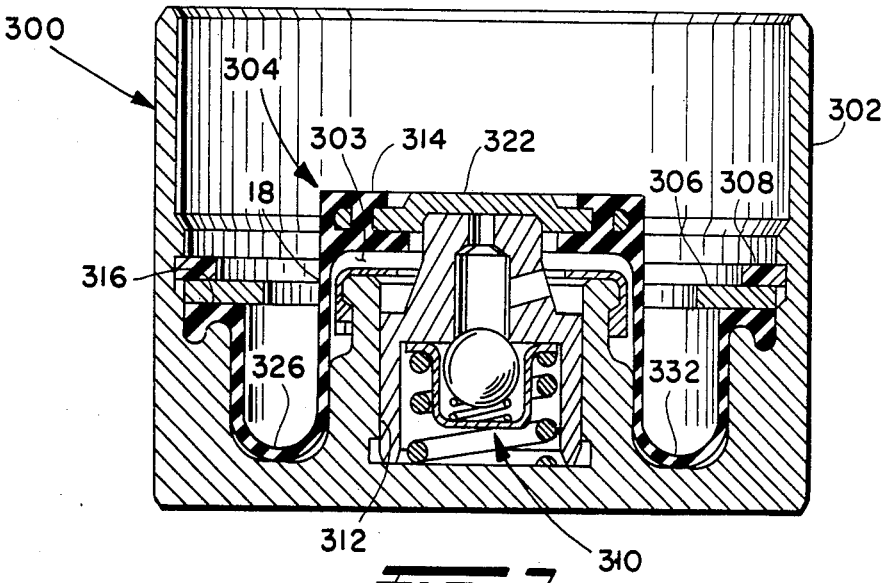
FIG. 7 is a section view taken along section-indicating lines 7—7 of FIG. 6; and, FIG. 8 is a partial section view taken along section-indicating lines 8—8 of FIG. 6.

Referring to FIG. 7, the diaphragm subassembly is indicated generally at 304 and is sealed about its periphery in the tappet body by a washer 306 retained therein by a suitable snap ring 308. A hydraulic lash adjusting plunger assembly, indicated generally at 310, is received in a guide bore 312 provided in the tappet body; and, the plunger assembly is substantially identical in structure and function with the hydraulic plunger assemblies described with respect to the embodiments of FIGS. 3 and 4.

Figure 8:
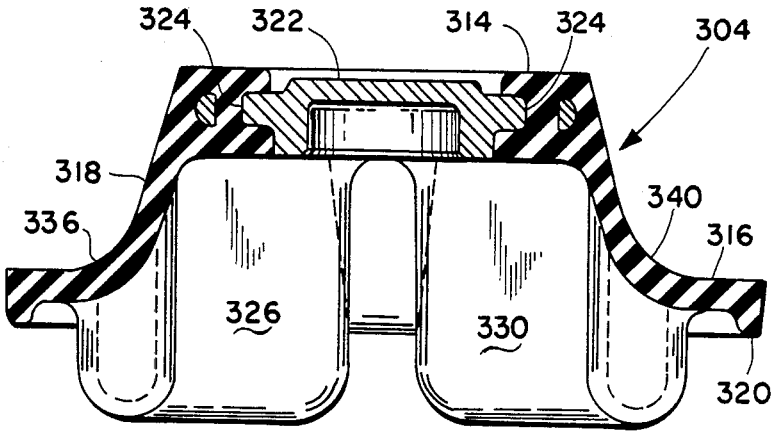

With reference to FIGS. 6, 7 and 8, the diaphragm subassembly has an inner peripheral portion 314, an outer peripheral rim or flange portion 316, and an intermediate flexible web portion 318 which interconnects the inner portion 314 and the outer rim 316. The outer peripheral rim 316 preferably has an axially extending bead 320 provided thereon to facilitate engagement and sealing within the body 302.

A rigid central force transmitting disc 322 is provided which has a plurality of axially extending retention surfaces comprising apertures 324 formed about the periphery thereof in circumferentially spaced arrangement, and the inner periphery of the diaphragm is preferably molded thereover such that the material of the diaphragm is received in the apertures 324 for providing positive retention of the inner portion 314 of the diaphragm onto the disc 322. It will be understood that the disc serves to transmit valve train forces from the hydraulic plunger assembly 310 to the end of the valve stem 26 (see FIG. 1).

The web portion 318 of the elastomeric flexible diaphragm has provided integrally thereon a plurality of flexible accumulators or pockets formed integrally therein in preferably circumferentially equally spaced arrangement as indicated in the drawings by the numerals 26, 328, 330 and 332. The accumulators or pockets extend in a direction axially with respect to the outer peripheral rim 316 and in a direction toward the closed end of the tappet body or into the fluid reservoir. In the presently preferred practice of the invention, the inner peripheral portion 315 is axially displaced from the outer peripheral rim 316 in a direction opposite that of the pockets to thus provide an axially offset configuration for the subassembly 304. The aforesaid offset configuration gives the radially inner faces of the pocket an axially extending elongated configuration to thereby provide improved flexibility therefor. The accumulator means functions to absorb, by localized flexing and displacement thereof, pressure transients in the fluid reservoir, which experience has taught are encountered during operation of the tappet in a firing engine.

The portions of the web 318 comprising the spaces between the accumulator means or pockets are configured to have an increased thickness with respect to the wall of the pocket to thereby form a plurality of stiffening ribs, indicated in FIG. 6 and 8 by the reference numerals 334, 336, 338 and 340, which extend axially between the inner peripheral portion 314 and the peripheral rim 316 to provide stiffness to the web 318. The employment of the ribs 334, 336, 338 and 340 has been found to provide improved flexural strength to the diaphragm subassembly 304 for preventing failure of the diaphragm in the region of the inner peripheral portion 314 and the outer rim 316. The increased thickness of the ribs permits the accumulators to absorb transient pressure fluctuations rather than cause unwanted sudden flexing of the diaphragm web 318.

In all other operational aspects, the embodiment of FIGS. 6, 7 and 8 function in the same manner as the embodiments described with references to FIGS. 1–5.

It is to be understood that the invention has been described with reference to specific illustrated embodiments which provide the features and advantages previously described; and, that such specific embodiments are susceptible of modification as will be apparent to those skilled in the art. Accordingly, the invention is limited only by the scope of the following claims.

We claim:

1. A self-contained hydraulic lash adjuster comprising:

(a) a generally cup-shaped body having a closed end and a cylindrical wall extending therefrom, the closed end thereof defining a face adapted to contact an engine cam, the inner side of said closed end defining a precision guide surface;

(b) hydraulic lash adjusting means including one-way valve means slidably received against said guide surface and defining a force transmitting surface, said lash adjusting means operative to adjust and hold the distance of said transmitting surface from said cam face;

(c) a flexible wall member disposed to close the open end of said cup over said lash adjustment means, said flexible wall member having the outer periphery thereof sealed about the inner periphery of the cylindrical wall of said cup to form a hydraulic fluid reservoir for said one way valve means, said flexible wall member having, (i) a rigid central portion operative to receive and transmit forces from said force transmitting surface;

(ii) a plurality of pockets formed therein and disposed in circumferentially spaced arrangement about said rigid central portion;

(iii) a plurality of stiffening rib portions formed integrally therein, with one of said rib portions disposed between adjacent ones of said pockets wherein the wall of each of said pockets is substantially more flexible under fluid pressure loading than said rib portions thereby allowing said pockets to absorb pressure transients by localized flexing thereof.

2. The lash adjuster defined in claim 1, where said rib portions extend generally parallel to the cylindrical wall of said cup.

3. The lash adjuster defined in claim 1, wherein said flexible wall member has an annular rim forming the outer periphery thereof and said rigid central portion is spaced from said annular rim in a direction extending axially thereof.

4. The lash adjuster defined in claim 1, wherein said rigid central portion includes a molded-in metal disc insert.

5. A diaphragm subassembly for a self-contained hydraulic lash adjuster comprising:

(a) a rigid plate having a plurality of apertures disposed in circumferentially spaced arrangement;

(b) a flexible annular diaphragm having an inner peripheral portion received over the periphery of said plate and having the material thereof engaging said apertures for retention of said diaphragm on said plate, said diaphragm having, (i) an outer peripheral rim portion adapted for sealing engagement with the body of a lash adjuster, said rim disposed in axially spaced arrangement with said plate, (ii) a web portion interconnecting said rim and said inner peripheral portion, said web having a plurality of pockets formed therein in circumferentially spaced arrangement and extending in a direction parallel to the axis of said annular diaphragm and a stiffening rib formed integrally in said web in the circumferential space between adjacent ones of said pockets and extending in a direction generally parallel to said axis, wherein the walls of said pockets are substantially more flexible than said ribs, said rim and said inner peripheral portion.

6. The diaphragm subassembly defined in claim 5, wherein said pockets are elongated in the circumferential direction.

7. The diaphragm subassembly defined in claim 5, wherein said rim portion has an axially extending annular sealing bead formed thereabout.

8. The diaphragm subassembly defined in claim 5, wherein said pockets extend axially from said web in a direction away from said plate.

9. The diaphragm subassembly defined in claim 5, wherein said rim portion is disposed axially intermediate said plate and the ends of said pockets.

10. A diaphragm subassembly for use in a self-contained hydraulic lash adjuster comprising:

(a) a rigid force transmitting plate member having a plurality of retention surfaces formed thereon and extending in a direction generally at right angles to the surface of said plate member;

(b) an annular flexible diaphragm formed of elastomeric material having, (i) an inner peripheral portion received over said plate about the peripheral thereof and engaging said retention surfaces for retaining said diaphragm inner portions over said plate member;

(ii) an outer rim portion adapted for sealing engagement with the body of a lash adjuster;

(iii) a web portion interconnecting said inner portion and said rim, said web having a plurality of pockets formed therein in circumferential arrangement, with a stiffening rib formed integrally with said web in the space between said pockets, the walls of said pockets being substantially more flexible than the rim, web and ribs for absorbing pressure transients when installed in said lash adjuster.

11. A diaphragm sub-assembly for a self-contained hydraulic lash adjuster for the valve gear of an engine comprising:

(a) a rigid plate member having a generally circular configuration and adapted for transmitting forces in the valve train of an engine;

(b) an elastomeric diaphragm with a generally annular configuration and having, (i) an inner peripheral portion received over the periphery of said plate in fluid sealing engagement;

(ii) an outer rim portion adapted for sealing engagement with the body of a lash adjuster, (iii) a web portion interconnecting said rim and inner peripheral portion, said web portion having a plurality of accumulator means formed therein disposed in circumferentially spaced arrangement with a stiffening rib formed integrally with said web portion in the space between adjacent accumulator means, said accumulator means having the walls thereof configured to be more flexible than said rim, inner portion and stiffening rib for permitting said pockets to absorb fluid pressure transients when installed in said lash adjuster.

12. The subassembly defined in claim 11, wherein said rim and said plate and inner peripheral portion are axially offset and said ribs extend generally axially therebetween.

13. The subassembly defined in claim 11, wherein said plate and inner peripheral portion are axially offset on one side of said rim portion and said accumulator means extend axially on the opposite side of said rim portion.

14. The subassembly defined in claim 11, wherein said plate has a plurality of retention surfaces formed thereon and extending in a direction generally perpendicular to the surface of said plate and the inner peripheral portion of said diaphragm positively engages said retention surfaces.

15. The subassembly defined in claim 11, wherein said accumulator means have an elongated configuration in the circumferential direction.

16. The subassembly defined in claim 11, wherein said accumulator means are circumferentially equally spaced and extend from said web portion in a generally axial direction with respect to the annulus of said diaphragm.

17. The subassembly defined in claim 11, wherein said plate has a plurality of circumferentially spaced apertures formed therein with the elastomeric material of said inner peripheral portion received in said apertures for retention of said diaphragm inner portion on said plate.

18. The subassembly defined in claim 11, wherein said accumulator means each comprises a pocket formed in said diaphragm.

* * * * *